US008795021B1

(12) United States Patent
Thompson

(10) Patent No.: US 8,795,021 B1
(45) Date of Patent: Aug. 5, 2014

(54) DIVING TOY WITH HYDROSTATIC DEPTH CONTROL

(76) Inventor: William Vernon Thompson, Stockton, CA (US)

( * ) Notice: Subject to any disclaimer, the term of this patent is extended or adjusted under 35 U.S.C. 154(b) by 358 days.

(21) Appl. No.: 13/449,987

(22) Filed: Apr. 18, 2012

Related U.S. Application Data

(60) Provisional application No. 61/553,246, filed on Oct. 30, 2011, provisional application No. 61/501,564, filed on Jun. 27, 2011.

(51) Int. Cl.
*A63H 23/10* (2006.01)

(52) U.S. Cl.
USPC ..... 446/155; 114/312; 114/317; 114/330; 446/176; 446/153

(58) Field of Classification Search
USPC ..... 446/176, 153–164; 114/312, 317, 330, 114/121, 125
See application file for complete search history.

(56) References Cited

U.S. PATENT DOCUMENTS

| | | | |
|---|---|---|---|
| 3,943,869 | A | 3/1976 | Frechette |
| 3,973,350 | A | 8/1976 | England |
| 4,826,465 | A | 5/1989 | Fleischmann |
| 5,514,023 | A | 5/1996 | Warner |
| 7,562,634 | B2 | 7/2009 | Shu |
| 8,033,890 | B2 | 10/2011 | Warner |

*Primary Examiner* — Gene Kim
*Assistant Examiner* — Urszula M Cegielnik

(57) ABSTRACT

A diving toy having hydrostatic depth control adapted to cause said diving toy to continuously seek a predetermined depth in water. The diving toy includes a sealed main body with a motor and a battery compartment for receiving at least one battery positioned inside the sealed main body. A propeller is attached to an axle of the motor protruding through the sealed main body so that when the motor is activated the propeller spins. The sealed main body has a flexible portion disposed substantially rearward on the sealed main body. The flexible portion is hydrostatic pressure sensitive varying the fluid displacement volume and volumetric center of the toy as it dives or climbs. The toy may be adapted to have positive, negative or neutral buoyancy when placed in water.

9 Claims, 1 Drawing Sheet

DIVING TOY WITH HYDROSTATIC DEPTH CONTROL

CROSS-REFERENCE TO RELATED APPLICATIONS

This application claims the benefit of provisional application Ser. No. 61/501,564, filed 2011 Jun. 27 and Ser. No. 61/553,246, filed 2011 Oct. 30 by the present inventor.

FEDERALLY SPONSORED RESEARCH

Not Applicable.

SEQUENCE LISTING OR PROGRAM

Not Applicable.

BACKGROUND

1. Field of the Invention

This invention relates generally to motorized swimming toys.

2. Prior Art

Ordinary motorized swimming toys are unsuited for sustained submerged travel. Some of them will quickly sink while others are light and not suited to do much more than travel along the surface. Although some toy submarines can dive they require sophisticated diving controls that make them relatively large and expensive. They are also limited to slow and boring motions. One popular gyroscopic swimming toy can repeatedly dive and surface but cannot continuously seek a predetermined depth.

SUMMARY

A diving toy having hydrostatic depth control adapted to cause said diving toy to continuously seek a predetermined depth in water. The diving toy includes a sealed main body with a motor and a battery compartment for receiving at least one battery positioned inside the sealed main body. A propeller is attached to an axle of the motor protruding through the sealed main body so that when the motor is activated the propeller spins. The sealed main body has a flexible portion disposed substantially rearward on the sealed main body. The flexible portion is hydrostatic pressure sensitive varying the fluid displacement volume and volumetric center of the toy as it dives or climbs. The toy may be adapted to have positive, negative or neutral buoyancy when placed in water.

DRAWING

Figures

REFERENCE NUMERALS

Figure 1:
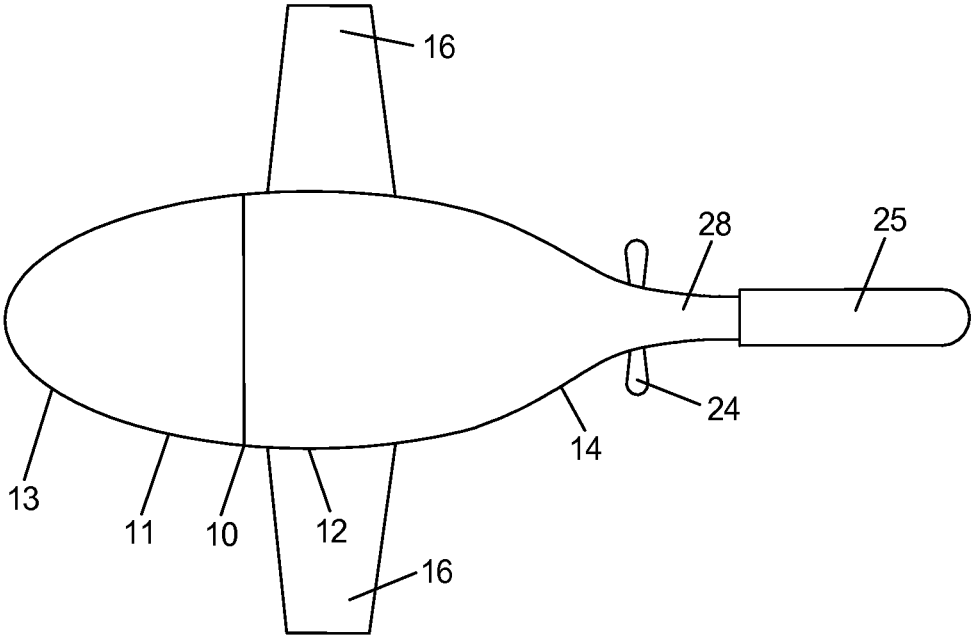
FIG. 1 is a top view of the diving toy constructed in accordance with the invention. The flexible portion of the sealed main body is shown at full volume.

10. Sealed main body
11. Front portion
12. Rear portion
13. Front end

14. Rear end
15. Tube
16. Horizontal wings
17. Axle of motor
18. Motor
19. Switch
20. Battery compartment
21. Cylindrical ballast
22. Swim bladder
23. Wires
24. Propeller
25. Flexible portion
26. Battery
27. Channel
28. Finger

DETAILED DESCRIPTION OF THE INVENTION

FIG. 1 is a top view of the diving toy constructed in accordance with the invention. It is comprised of sealed main body 10 with a finger 28 formed at rear end 14 of sealed main body 10 extending longitudinally above propeller 24. Flexible portion 25 is disposed at the rear of finger 28. Sealed main body 10 is streamlined for maximum drag reduction. Front portion 11 and rear portion 12 are detachable. Two horizontal wings 16 protrude from rear portion 12 to dampen any purely vertical movement of the toy and to facilitate any forward movement of the toy, wings 16 along with a low center of gravity also effectively resist torque created by the spin of propeller 24. Flexible portion 25 shown at full volume positions the volumetric center of the toy in a rewardly position causing the toy when in action underwater to seek an inclined forward/downward position. Alternatively propeller 24 may be attached to front end 13 instead and a rudder or other means may be added to cause the toy to move substantially in a circle also wings 16 may be eliminated by suitably shaping main body 10.

Figure 2:
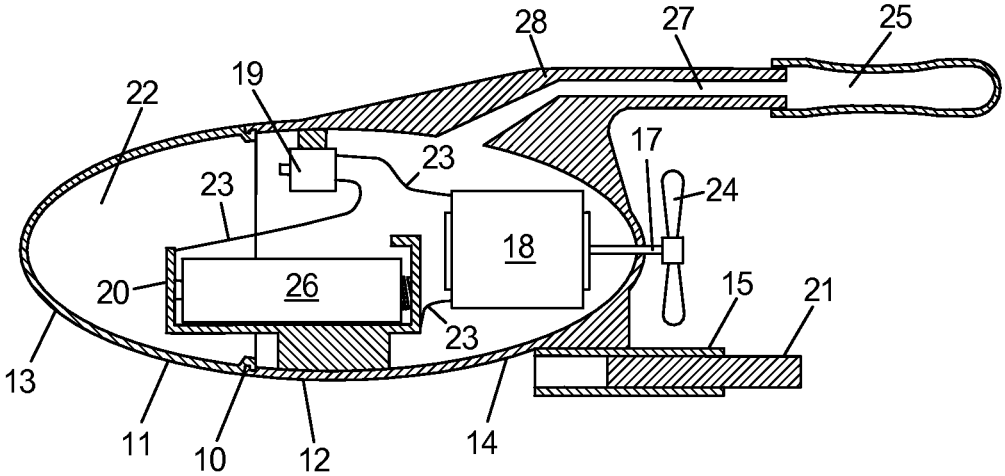
FIG. 2 is a side sectional view of the diving toy. The flexible portion of the sealed main body is shown with a reduced volume.

FIG. 2 is a side sectional view of the diving toy. Swim bladder 22 and flexible portion 25 communicate with each other through channel 27 formed through finger 28 to increase the sensitivity of flexible portion 25 to varying hydrostatic pressure. Battery compartment 20 is attached inside rear portion 12 for receiving battery 26. The bottom of rear end 14 features tube 15 with cylindrical ballast 21 frictionally held in tube 15, ballast 21 can be moved forward or backward in tube 15 to adjust the toys balance. In combination with battery 26, ballast 21 is arranged to provide a low center of gravity. Flexible portion 25 when at a predetermined reduced volume positions the volumetric center of the toy in a forwardly position causing the toy when in action underwater to seek an inclined forward/upward position. Motor 18 is connected to battery compartment 20 by wires 23 and switch 19. Motor 18 is activated by switch 19. Propeller 24 is attached to an axle 17 of motor 18 protruding through sealed main body 10 such that when motor 18 is activated the propeller 24 spins. Ballast 21 may be eliminated by suitably shaping sealed main body 10 for the desired center of gravity and suitably sizing swim bladder 22 for the desired buoyancy. Also, another arrangement for activating motor 18 may be provided. Resilient seals (not shown) are provided at all joints for waterproofing.

Operation

With motor 18 (FIG. 2) running the toy is placed in a body of water and forces generated by the spin of propeller 24 (FIGS. 1 and 2) propel the toy in a continuous forward diving movement until increasing hydrostatic pressure causes flexible portion 25 to decrease in volume (FIG. 2) moving the volumetric center of the toy forward causing the toy to move from an inclined forward/downward position to an inclined forward/upward position, whereby the toy begins a forward rising movement. As the toy rises decreasing hydrostatic pressure causes flexible portion 25 to increase in volume moving the volumetric center of the toy reward causing the toy to return to an inclined forward/downward position sending the toy into another forward diving movement, this cycle will continue automatically causing the toy to continuously seek a predetermined depth for amusement.

CONCLUSION, RAMIFICATION, AND SCOPE

Having described one specific embodiment of my invention, it is not desired to limit the invention to the exact construction and operation shown and described. The forgoing is considered as illustrative only of the principles of the invention it is obvious that many modifications and variations of the present invention are possible. The relative positions of the elements can vary, and the shapes of the elements can vary. For example the toy can be in the shape of a submarine or animal such as a stingray, etc. It is therefore to be understood that all suitable modification and equivalents may be resorted to, falling within the scope of the invention.

I claim:

1. A diving toy having hydrostatic depth control adapted to cause said diving toy to continuously seek a predetermined depth in water, comprising:

(a) a sealed main body having a predetermined orientation and buoyancy when placed in water, said sealed main body having a flexible portion disposed substantially rearward on said sealed main body for varying the volumetric center of said toy as it dives or rises;

(b) an electric motor in said sealed main body;

(c) a propeller attached to said motor;

(d) a battery for powering said motor;

whereby when said motor is activated forces generated by the spin of said propeller propel said toy in a continuous forward diving movement, and when increasing hydrostatic pressure causes the volume of said flexible portion of said sealed main body to decrease by a predetermined amount the volumetric center of said toy moves forward causing said toy to move from an inclined forward/downward position to an inclined forward/upward position which causes said toy to begin a forward rising movement, and when decreasing hydrostatic pressure causes the volume of said flexible portion to increase by a predetermined amount the volumetric center of said toy moves reward causing said toy to return to a forward diving movement, said toy is caused to repeatedly dive and rise automatically underwater by hydrostatic forces acting on said flexible portion of said sealed main body causing said toy to continuously seek a predetermined depth.

2. The diving toy of claim 1, wherein said sealed main body is elongated with a stream lined shape and well defined forward movement direction shaped extremities for reduced drag.

3. The diving toy of claim 1, further including a ballast for adjusting balance and buoyancy.

4. The diving toy of claim 1, further including a swim bladder in said sealed main body for communicating with said flexible portion of said sealed main body for increasing the sensitivity of said flexible portion to varying hydrostatic pressure.

5. The diving toy of claim 1, further including a pair of horizontal wings protruding from said sealed main body for damping any purely vertical movement of said diving toy and to facilitate any forward movement of said toy.

6. The diving toy of claim 1, further including means for causing said toy to move substantially in a circle.

7. A diving toy having hydrostatic depth control adapted to cause said diving toy to continuously seek a predetermined depth in water, comprising:

(a) a sealed main body having a predetermined orientation and buoyancy when placed in water, wherein said sealed main body is elongated with a stream lined shape and well defined forward movement direction shaped extremities for reduced drag, said sealed main body having a flexible portion disposed substantially rearward on said sealed main body for varying the volumetric center of said toy as it dives or rises;

(b) an electric motor in said sealed main body;

(c) a propeller attached to said motor;

(d) a battery for powering said motor;

(e) a ballast for adjusting balance and buoyancy;

(f) a swim bladder in said sealed main body communicating with said flexible portion of said sealed main body for increasing the sensitivity of said flexible portion to varying hydrostatic pressure;

whereby when said motor is activated forces generated by the spin of said propeller propel said toy in a continuous forward diving movement, and when increasing hydrostatic pressure causes the volume of said flexible portion of said sealed main body to decrease by a predetermined amount the volumetric center of said toy moves forward causing said toy to move from an inclined forward/downward position to an inclined forward/upward position which causes said toy to begin a forward rising movement, and when decreasing hydrostatic pressure causes the volume of said flexible portion to increase by a predetermined amount the volumetric center of said toy moves reward causing said toy to return to a forward diving movement, said toy is caused to repeatedly dive and rise automatically underwater by hydrostatic forces acting on said flexible portion of said sealed main body causing said toy to continuously seek a predetermined depth.

8. The diving toy of claim 7, further including a pair of horizontal wings protruding from said sealed main body for damping any purely vertical movement of said diving toy and to facilitate any forward movement of said toy.

9. The diving toy of claim 7, further including means for causing said toy to move substantially in a circle.

* * * * *